US006049311A

United States Patent [19]

Alexanian

[11] Patent Number: 6,049,311

[45] Date of Patent: Apr. 11, 2000

[54] PLANAR FLAT PLATE SCANNING ANTENNA

[75] Inventor: Angelos Alexanian, Boston, Mass.

[73] Assignee: The Whitaker Corporation, Wilmington, Del.

[21] Appl. No.: 09/263,616

[22] Filed: Mar. 5, 1999

[51] Int. Cl.[7] ..... H01Q 13/10

[52] U.S. Cl. ..... 343/771; 343/700 MS; 343/753; 343/909

[58] Field of Search ..... 343/700 MS, 753, 343/754, 757, 767, 770, 771, 781 P, 785, 850, 853, 909, 911 R, 911 L

[56] References Cited

U.S. PATENT DOCUMENTS

| | | | |
|---|---|---|---|
| 4,183,618 | 1/1980 | Rush et al. | 350/96.18 |
| 4,188,632 | 2/1980 | Knox | 343/753 |
| 5,426,443 | 6/1995 | Jenness | 343/781 P |

*Primary Examiner*—Hoanganh Le
*Assistant Examiner*—Tho Phan

[57] ABSTRACT

A scanning antenna (1) has, a first waveguide (2) with parallel metal plates (10, 11), a waveguide feed (19) substantially at a focus (15) of the first waveguide (2), the plates (10, 11) being partially filled therebetween with a biconvex dielectric body (21) emanating a wave of planar phase front, and a planar waveguide bend (4) having a planar profile (13) redirecting an incident wave of planar phase front for propagation in a second waveguide (3) having an array of radiating antenna elements (5).

14 Claims, 5 Drawing Sheets

PLANAR FLAT PLATE SCANNING ANTENNA

BACKGROUND OF THE INVENTION

A known scanning antenna is disclosed in PCT Application Number WO 91/17586 having first and second, flat plate waveguides connected by a waveguide bend. Waveforms at a focus of the first waveguide propagate as a beam of plane waves having a nonplanar, thin cylindrical, phase front, and become redirected by a parabolic profile of the waveguide bend to a beam for propagation in the second waveguide having an array of antenna apertures to be illuminated by the redirected beam.

In the known antenna, the waveguide bend has a parabolic profile that redirects the nonplanar phase front in reverse, by a $2\pi$ change in phase, to propagate in the second waveguide. The parabolic profile of the waveguide bend has a detrimental effect on the redirected phase front. A parabolic profile must be selected so as to provide a redirected beam pattern that may vary from, a narrow beam pattern with low side lobes, characteristic of a deep parabolic profile, to a broader beam pattern of more uniform illumination of the array of antenna elements with higher scattering, characteristic of a shallow parabolic profile. Accordingly, attainment of a redirected beam with a planar phase front is difficult to attain by a waveguide bend with a parabolic profile redirecting a beam having an nonplanar phase front.

In the known antenna, the first waveguide has parallel metal plates filled therebetween with dielectric material. The dielectric material extends from the focus of the waveguide to the parabolic waveguide bend. The dielectric material is without a desired feature that would emanate a planar phase front toward the waveguide bend. A wave of planar phase front would simplify the waveguide bend to a planar profile, and would reduce the detrimental effect of a parabolic waveguide bend on the redirected phase front.

SUMMARY OF THE INVENTION

According to the invention, the first waveguide has a waveguide feed substantially at a focus of the first waveguide, the focus being the focus of a biconvex dielectric body partially filling between parallel metal plates of the waveguide and emanating a wave of planar phase front incident on a planar waveguide bend having a planar profile directly opposite the dielectric body from the focus, the planar profile redirecting an incident wave of planar phase front for propagation in a second waveguide superposed with the first waveguide.

The planar profile reduces a need to focus a redirected beam of planar phase front, and reduces beam scattering due to off-axis propagation of a redirected phase front.

Embodiments of the invention will now be described by way of example with reference to the drawings, according to which:

DESCRIPTION

Figure 1:
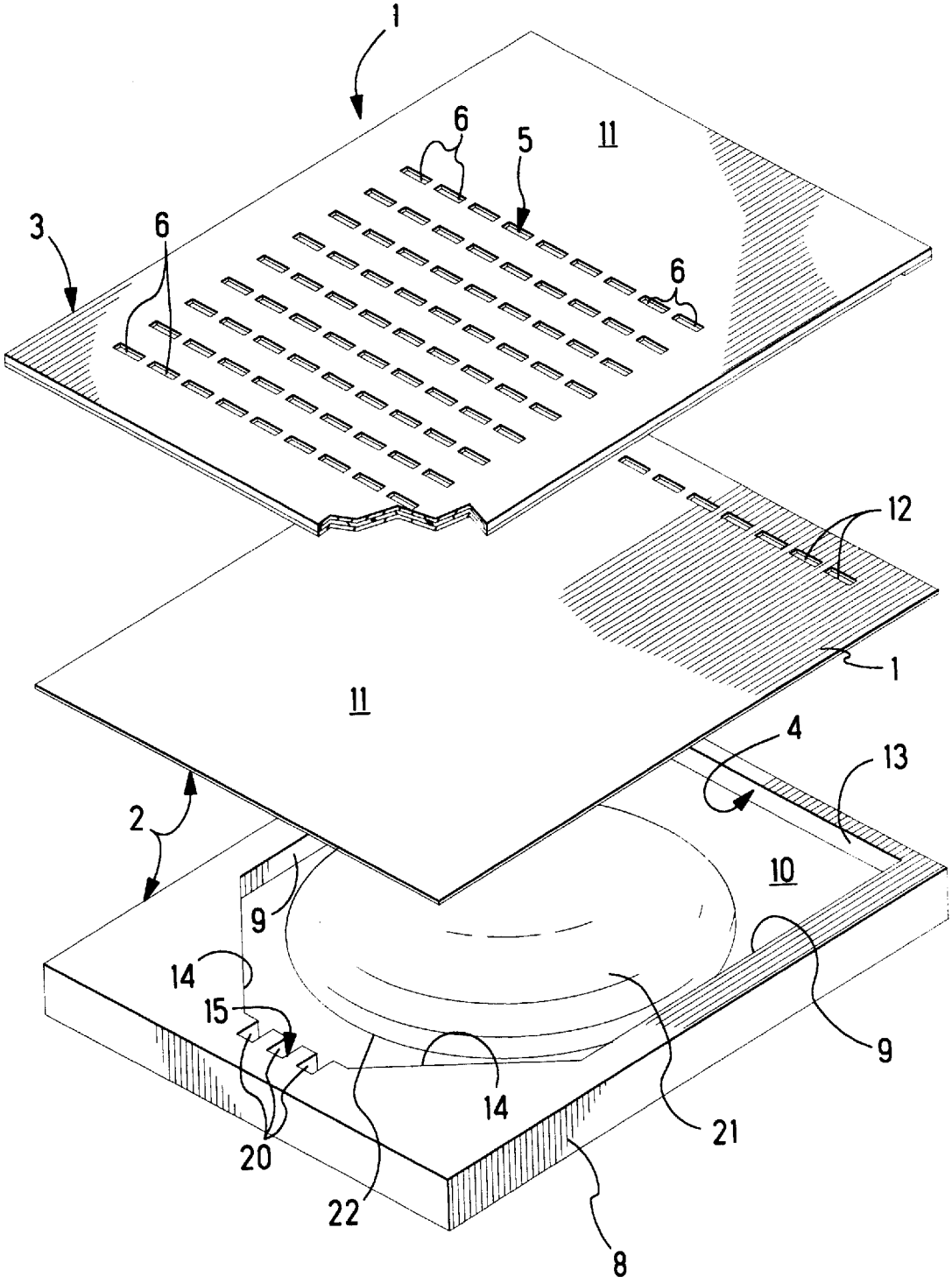
FIG. 1 is an isometric view of a scanning antenna with parts separated from one another.

With reference to each of FIGS. 1, 2, 3 and 7, a scanning antenna 1 suitable for mm-wave, millimeter-wave, 77 gHz., for example, has a flat plate, first waveguide 2 and a flat plate, second waveguide 3 connected by a waveguide bend 4. In the first waveguide 2, a wave form propagates from a focus 15 of the first waveguide 2, and becomes redirected by the profile 13 of the waveguide bend 4 for propagation in the second waveguide 3 having an array of antenna elements 5 in the form of apertures 6, FIG. 1, or, alternatively, antenna patch elements 7, FIGS. 2, 3 and 7.

With reference to each of FIGS. 1, 2, 3 and 7, the first waveguide 2 is fabricated with a suggested construction as a metal conducting body 8 providing side walls 9 unitary with a conducting base plate 10, together defining a cavity for mm-wave propagation. The side walls 9 are magnetically lossy material absorbing misdirected, mm-waves. A conducting top plate 11 covers the cavity, and registers on the side walls 9. The top plate 11 has a single row of apertures 12 for the waveguide bend 4. The side walls 9 meet the reflecting profile 13 of the waveguide bend 4 at an end of the first waveguide 2. The side walls 9 meet respective walls 14 that taper to a focus 15 of the first waveguide 2.

Figure 4:
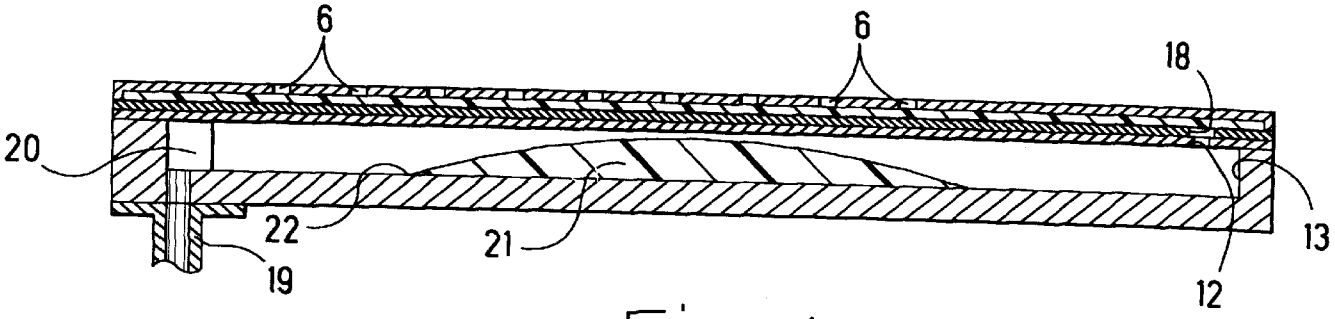
FIG. 4 is an enlarged section view of the scanning antenna as shown in FIG. 1, and with the parts assembled.
Figure 5:
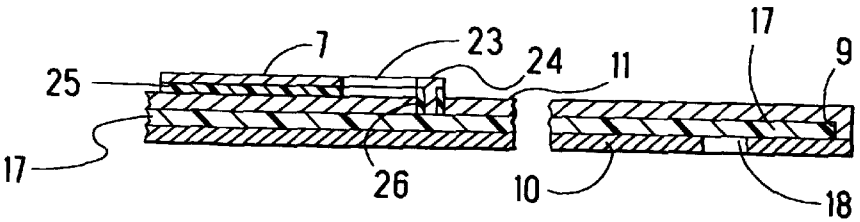
FIG. 5 is an enlarged section view taken along the line 5—5 of FIG. 6.
Figure 6:
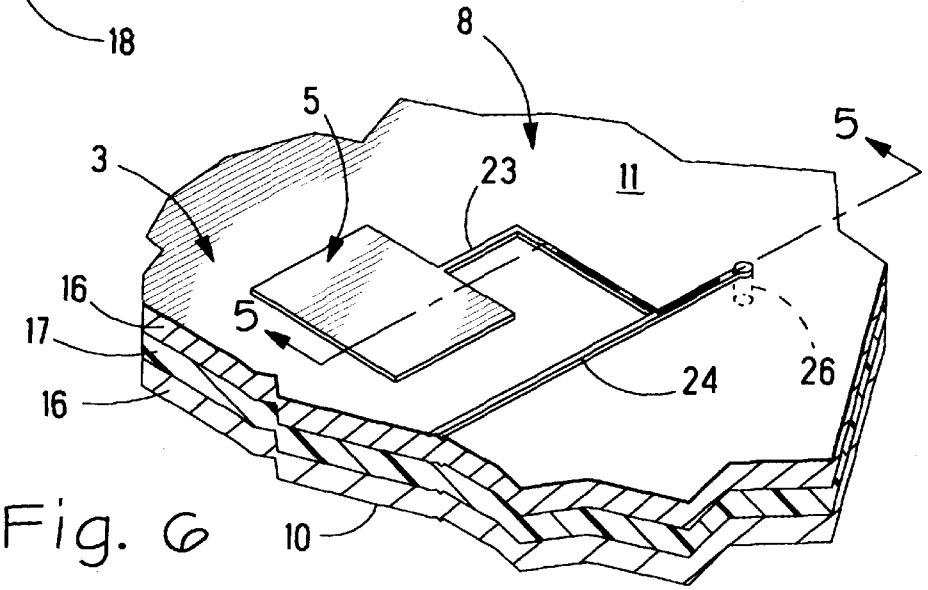
FIG. 6 is an enlarged fragmentary view of a portion of the scanning antenna as shown in FIG. 1.

With reference to FIG. 6, the second waveguide 3 has copper cladding 16 surrounding a sheet of dielectric material 17 such as polytetrafluoroethylene. The copper cladding 16 forms the conducting body 8, similar to the conducting body 8 of the first waveguide 2, with a base plate 10 and a parallel top plate 11. The dielectric material 17 fills between the base plate 10 and the top plate 11, and serves as the propagation medium. An exemplary antenna element 5 is shown in FIG. 6. As shown in FIGS. 4 and 5, a waveguide opening 18 through the base plate 10 is aligned with the apertures 12 of the waveguide bend 4.

With reference to FIG. 4, a waveguide feed 19 is substantially at the focus 15 of the first waveguide 2. For example, the waveguide feed 1 comprises at least one waveguide duct 20, FIGS. 1, 2, 3 and 7, or multiple waveguide ducts 20 substantially at the focus 15, for example, feeding a wave in opposite, transmitting and receiving directions, depending upon which duct 20 is connected to a transmitter portion or receiver portion of a known electronic transceiver apparatus, not shown. The direction of propagation applies in reference to a transmit mode, when a wave propagates from the focus 15. The direction of propagation further applies in reference to a receive mode, when a wave propagates toward the focus 15.

Figure 3:
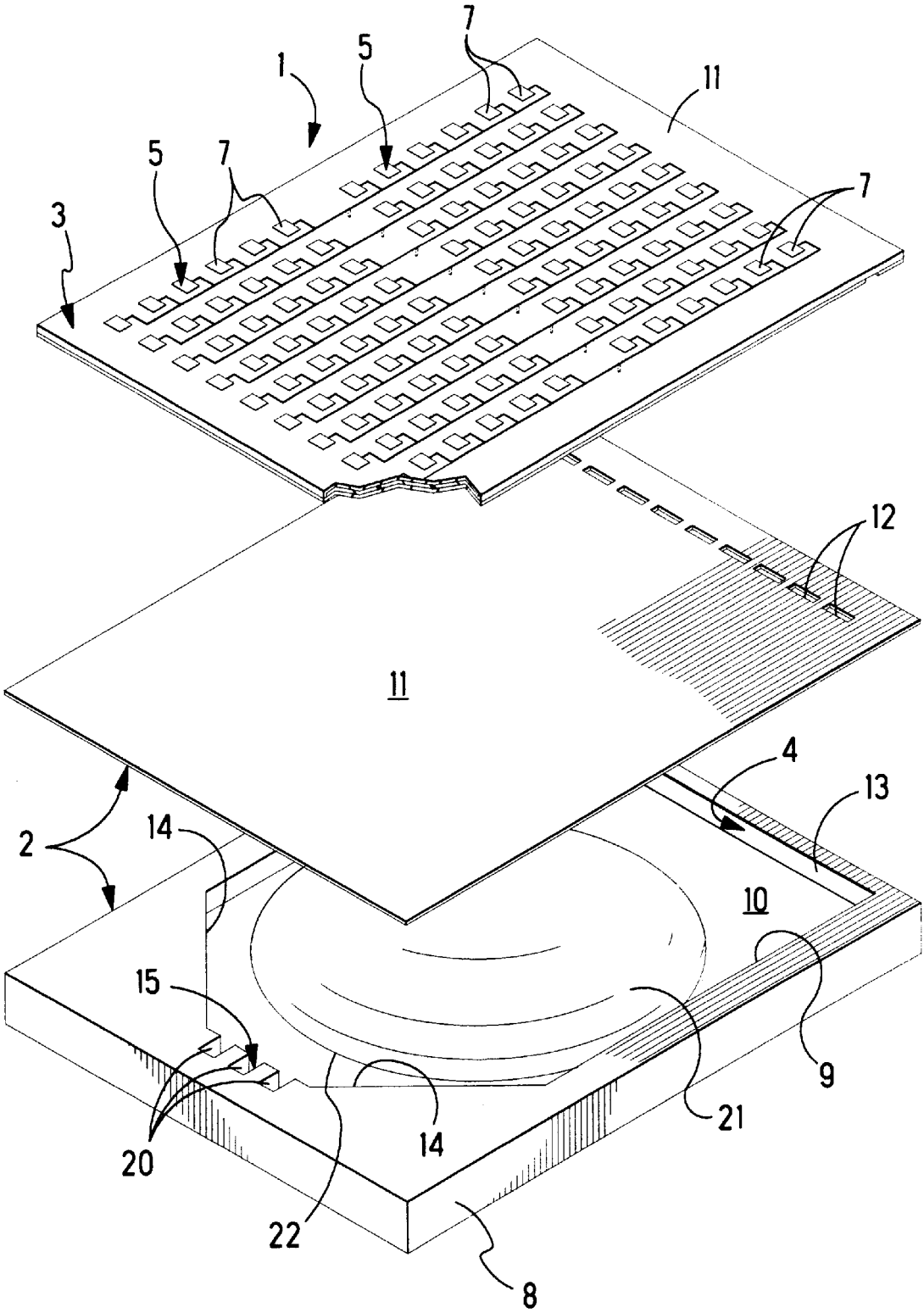
FIG. 3 is an isometric view of another embodiment of a scanning antenna with parts separated from one another.
Figure 7:
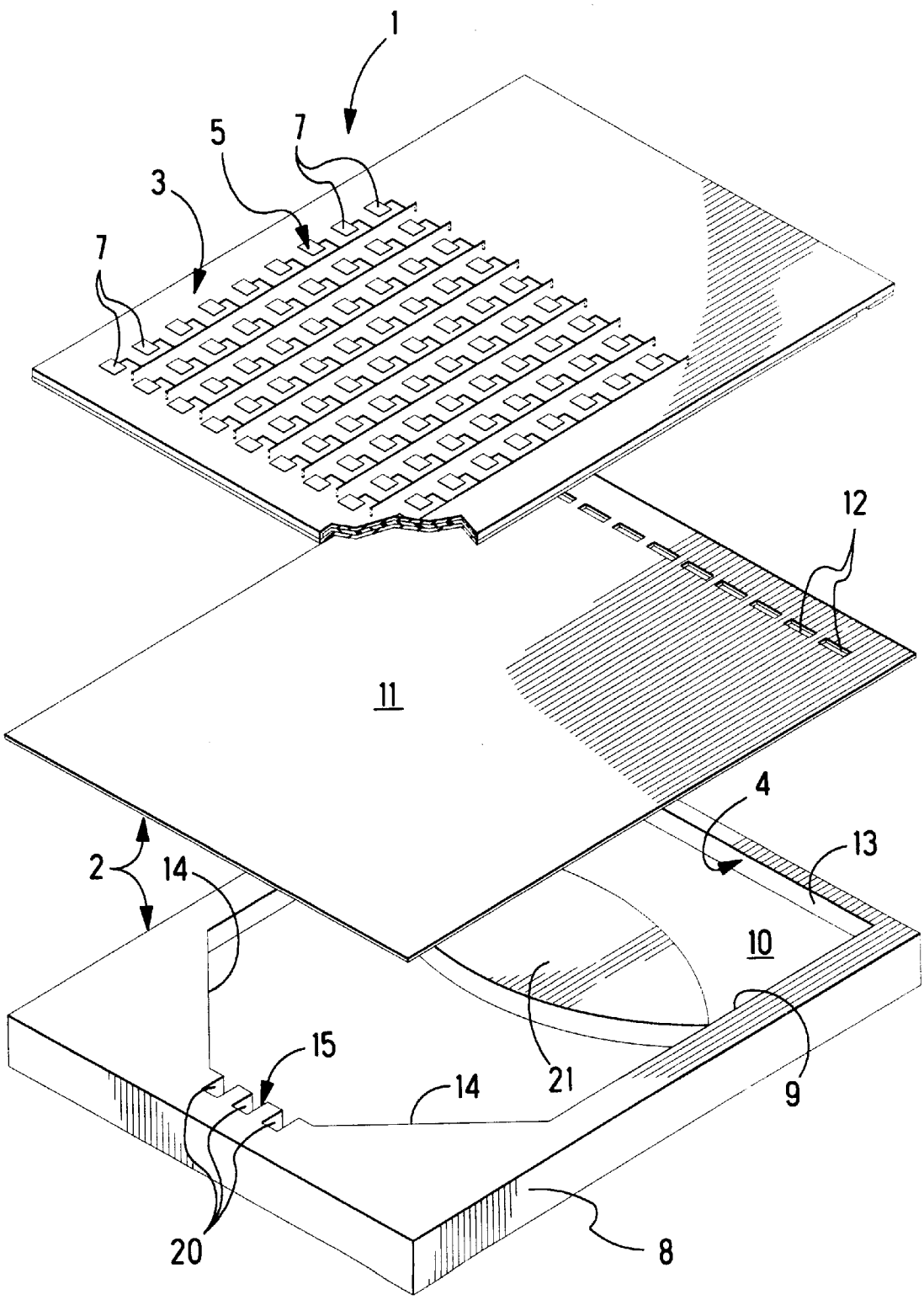
FIG. 7 is an isometric view of another embodiment of a scanning antenna.

With reference to FIGS. 1, 3 and 7, a biconvex dielectric body 21 will now be described. The biconvex dielectric body 21 is spaced from the focus 15 and from the waveguide bend 4, and, thereby, partially fills between the metal plates 10 and 11 of the first waveguide 2. The remaining area between the plates 10 and 11 is filled with air as a dielectric medium of propagation.

The dielectric body 21 is biconvex in the direction of propagation, serves as a mm-wave lens, and has, as its lens focus 15, the focus 15 of the first waveguide 2. Because the first waveguide 2 is very thin, a wave propagating from the focus 15 toward the dielectric body 21 will have a nonplanar, thin cylindrical, phase front, and will be incident on the dielectric body 21. The dielectric body 21 is biconvex in the direction of propagation to emanate the wave with a planar phase front propagating toward the waveguide bend 4. An incident wave of planar phase front simplifies the shape of the waveguide bend 4 to a planar profile 13.

The planar phase front becomes redirected by the planar profile 13 of the waveguide bend 4 for propagation, in reverse, in the second waveguide 3 as a beam of planar phase front. Due to the planar profile 13, the redirected beam of planar phase front is focused at infinity, which avoids a need to focus the redirected beam to reduce scattering by off-axis propagation of redirected phase fronts. The planar phase front provides uniform illumination of the array of antenna elements 5, with reduced scattering loss due to the beam spreading laterally.

The planar profile 13 of the waveguide bend 4 reduces the detrimental effect of a known parabolic waveguide bend 4 on the redirected phase front. A parabolic profile must be selected so as to provide a redirected beam pattern that varies from, a narrow beam pattern with low side lobes, characteristic of a deep parabolic profile, to a broader beam pattern of more uniform illumination of the array of antenna elements 5 with higher scattering, characteristic of a shallow parabolic profile. Accordingly, a redirected beam with a planar phase front, and with minimum skattering, is difficult to attain with a parabolic profile being used to redirect a beam having a nonplanar phase front.

According to one embodiment, in FIG. 7, the dielectric body 21 is of uniform thickness, transverse to the direction of propagation, and of uniform dielectric constant, and is biconvex in the direction of propagation. The thickness bridges between the parallel plates 10 and 11 that have a plate spacing sufficiently small for propagation of a wave of TEM mode. Propagation of a wave in the dielectric body 21 can be modeled by an analysis of an optical wave propogating through an optically transmitting biconvex lens.

Figure 2:
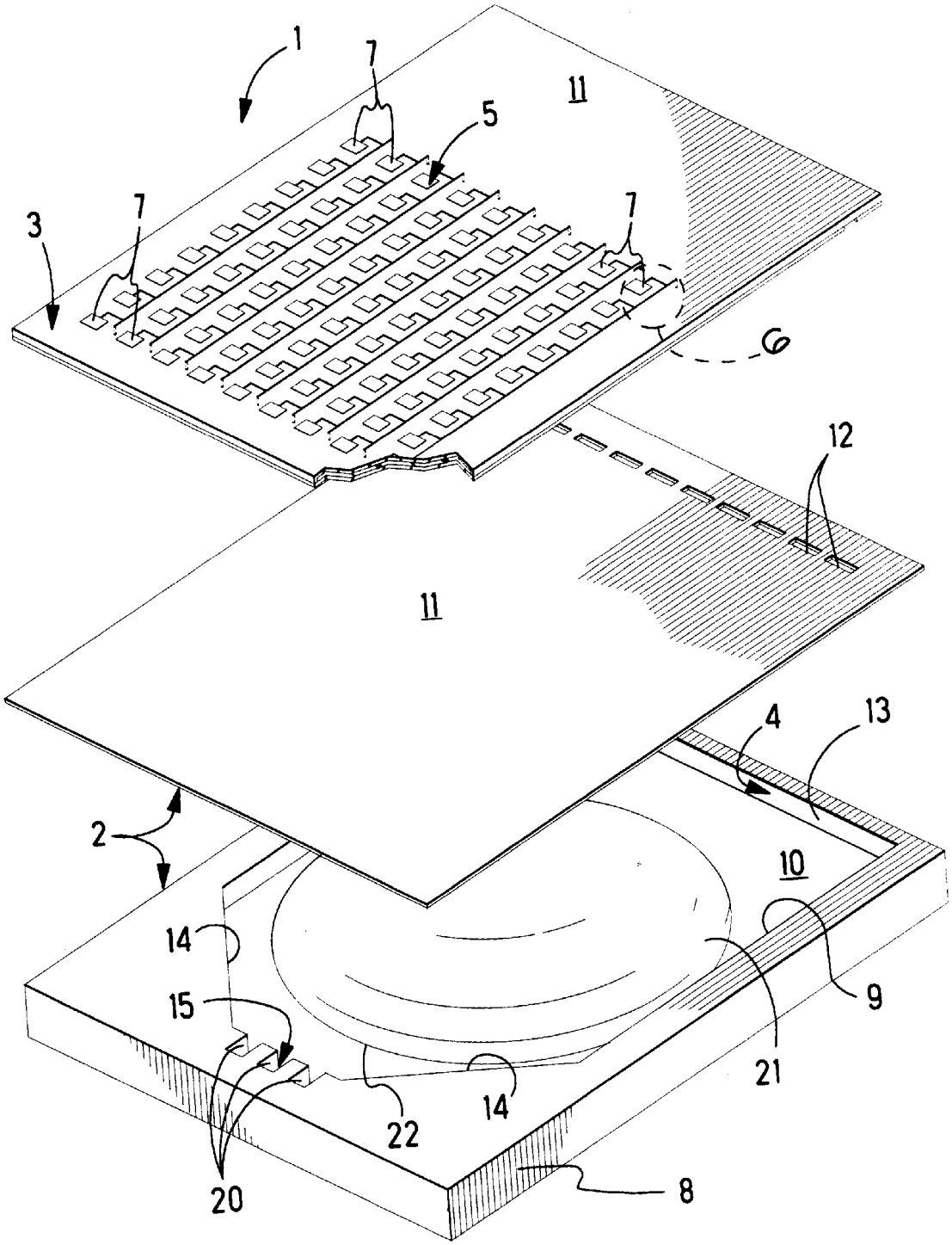
FIG. 2 is an isometric view of another embodiment of a scanning antenna with parts separated from one another.

According to another embodiment, in each of FIGS. 1, 2 and 3, the dielectric body 21 is of uniform dielectric constant and is cylindrical about an axis transverse to the direction of propagation, with a thickness progressively increasing concentrically from a minimum thickness at a cylindrical edge 22.

The effective index of refraction for this mode is expressed as:

$$\tan\,[k_1(s-t)]+k_2/\epsilon_r\,[\tan(k_2 t)]=0$$

where $$k_1=2\,\pi/\lambda(1-n^2)^{1/2},\ k_2=2\,\pi/\lambda(\epsilon_r-n^2)^{1/2}$$

s is the spacing between the plates t is the thickness $\epsilon_r$ is the dielectric constant of the body $\lambda$ is the free space wavelength A slight deformation from parallelism of the interface between air and the dielectric body 21 has an insignificant effect on the velocity of the wave at any point when the thickness varies, so that a known Luneberg relation is satisfied, according to the equation:

$$n^2=2-(r/R)^2$$

where:

n=dielectric constant r=radial distance from center axis

R=radius of waveguide at the center of the waveguide, r=0, and n=2, its maximum value. When r=R, n=1.

With reference to FIG. 6, the antenna patch elements 7 are unitary with respective, conducting, secondary feed lines 23 linked to a unitary primary feed line 24. As shown in FIG. 4, the patch elements 7 and the secondary feed lines 23 and each primary feed line 24 are fabricated, for example, as a pattern of plated metal adhered to dielectric material 25, in turn, adhered to the top plate 11. The plated metal extends through an opening in the top plate 11, and is encircled by the dielectric material in the opening to provide a coaxial feed 26. Further details of the patch elements 7 and their construction are described in U.S. Pat. No. 5,712,644, incorporated herein by reference.

In summary, a scanning antenna has first and second, flat plate waveguides 2 and 3 connected by a waveguide bend 4. Wave forms at a focus 15 of the first waveguide 2 propagate with a nonplanar phase front, and emanate with a planar phase front from a biconvex dielectric body 21 toward the profile 13 of the waveguide bend 4 for propagation in the second waveguide 3 having an array of radiating antenna elements 5.

The first waveguide 2 has parallel metal plates, a waveguide feed 19 substantially at a focus 15 of the waveguide, the plates being partially filled therebetween with a biconvex dielectric body 21 emanating a wave of planar phase front, and a planar waveguide bend 4 having a planar profile 13 directly opposite the dielectric body 21 from the focus 15, the planar profile 13 redirecting an incident wave of planar phase front for propagation in a second waveguide 3 superposed with the first waveguide 2.

Other embodiments and modifications of the invention are intended to be covered by the spirit and cope of the appended claims.

What is claimed is:

1. A scanning antenna comprising: a first waveguide having parallel metal plates, a waveguide feed substantially at a focus of the first waveguide, the plates being partially filled therebetween with a biconvex dielectric body emanating a wave of planar phase front, and a planar waveguide bend having a planar profile directly opposite the dielectric body from the focus, the planar profile redirecting an incident wave of planar phase front for propagation in a second waveguide superposed with the first waveguide, and the second waveguide having an array of radiating antenna elements.

2. A scanning antenna as recited in claim 1 wherein, the radiating antenna elements are antenna patch elements connected by secondary feed lines to a primary feed line, and a coaxial feed through a conducting top plate of the second waveguide.

3. A scanning antenna as recited in claim 1 wherein, the radiating antenna elements are apertures in a phased array.

4. A scanning antenna as recited in claim 1 wherein, the dielectric body is biconvex in the direction of propagation for either a transmit mode or a receive mode.

5. A scanning antenna as recited in claim 1 wherein, the dielectric body has a progressively increasing thickness from a minimum at a cylindrical circumference to a maximum along an axis transverse to a direction of propagation.

6. A scanning antenna as recited in claim 1 wherein, the biconvex dielectric body has a constant thickness and a uniform dielectric constant.

7. A waveguide as recited in claim 6 wherein, the dielectric body is biconvex in the direction of propagation for either a transmit mode or a receive mode.

8. A waveguide as recited in claim 6 wherein, the dielectric body has a progressively increasing thickness from a minimum at a cylindrical circumference to a maximum along an axis transverse to a direction of propagation.

9. A waveguide as recited in claim 6 wherein, the biconvex dielectric body has a constant thickness and a uniform dielectric constant.

10. A waveguide of a scanning antenna comprising:

a waveguide feed substantially at a focus of a biconvex dielectric body partially filling between parallel metal plates, the dielectric body emanating a wave of planar phase front incident on a planar waveguide bend having a planar profile directly opposite the dielectric body from the focus, the planar profile redirecting an incident wave of planar phase front for propagation in another waveguide having antenna radiating elements.

11. A scanning antenna comprising: first and second, flat plate waveguides connected by a waveguide bend, a focus of the first waveguide propagating a wave having a nonplanar phase front toward a biconvex dielectric body, the body emanating the wave with a planar phase front toward a planar profile of a waveguide bend for propagation in the second waveguide having an array of radiating antenna elements.

12. A scanning antenna as recited in claim 11 wherein, the dielectric body is biconvex in the direction of propagation for either a transmit mode or a receive mode.

13. A scanning antenna as recited in claim 11 wherein, the dielectric body has a progressively increasing thickness from a minimum at a cylindrical circumference to a maximum along an axis transverse to a direction of propagation.

14. A scanning antenna was recited in claim 11 wherein, the biconvex dielectric body has a constant thickness and a uniform dielectric constant.

* * * * *